United States Patent [19]

Dandridge et al.

[11] Patent Number: 4,993,718

[45] Date of Patent: Feb. 19, 1991

[54] METHOD OF PLAYING A BOARD GAME

[76] Inventors: Rita M. Dandridge; Steven E. Dandridge, both of 1114 S. Broom St., Wilmington, Del. 19805

[21] Appl. No.: 436,696

[22] Filed: Nov. 15, 1989

[51] Int. Cl.[5] ..... A63F 3/00; A63F 9/18

[52] U.S. Cl. ..... 273/249

[58] Field of Search ..... 273/249, 243, 248, 250–254

[56] References Cited

U.S. PATENT DOCUMENTS

| | | | |
|---|---|---|---|
| 4,090,717 | 5/1978 | Rossetti | 273/249 |
| 4,109,918 | 8/1978 | Mele et al. | 273/256 |
| 4,216,594 | 8/1980 | Farley et al. | 273/243 |
| 4,273,337 | 6/1981 | Carrera et al. | 273/243 |
| 4,315,627 | 2/1982 | Schlegel et al. | 273/249 |
| 4,671,516 | 6/1987 | Lizzola et al. | 273/299 |
| 4,718,675 | 1/1988 | Rosenberg et al. | 273/243 |

FOREIGN PATENT DOCUMENTS

| | | | |
|---|---|---|---|
| 2189159 | 10/1987 | United Kingdom | 273/254 |

OTHER PUBLICATIONS

"Pictionary", Games Magazine, Mar. 1986, p. 48.

*Primary Examiner*—Benjamin Layno
*Attorney, Agent, or Firm*—Jerry T. Kearns

[57] ABSTRACT

A board game includes a game board having a movement path defined by a plurality of sequential spaces and including start and finish spaces. A plurality of game markers are assigned to game players for movement along the path. A sequentially numbered die is utilized to determine seating order and the order of play among a group of players. A multi-colored die has a plurality of differently colored faces. A plurality of cards each have a front face bearing indicia designating famous individuals in various categories. Each of the cards has a rear face bearing indicia designating a description clue corresponding to each of the famous individuals. The categories are color coded corresponding to the colors of the multi-colored die. A timer is utilized to control the length of each player's turn. During play, each player rolls the multi-colored die to select a category, draws a card and gives verbal descriptive clues to an adjacent player in an attempt to elicit a correct identification of the famous individual in the designated category. The initial player continues to draw cards and describes individuals in the indicated catagory until time expires. The players move their respective game markers in correspondence to the number of correctly elicited responses.

2 Claims, 3 Drawing Sheets

METHOD OF PLAYING A BOARD GAME

BACKGROUND OF THE INVENTION

1. Field of the Invention

The present invention relates to board games, and more particularly pertains to a board game of the type which utilizes a race track type movement path upon which a plurality of game markers are moved.

2. Description of the Prior Art

Various types of board games are known in the prior art. A typical example of such a board game is to be found in U.S. Pat. No. 4,109,918, which issued to F. Mele et al on Aug. 29, 1978. This patent discloses a board game defining a circumferential path of travel formed by a plurality of zones, each containing a respective designation of a discipline of learning. Groups of cards include question and answers of corresponding subjects. U.S. Pat. No. 4,216,594, which issued to C. Farley et al on Aug. 12, 1980, discloses a psychotherapeutic testing game for providing a game playing atmosphere between a tester and a player. A plurality of cards for selection by a game selection device contain information to elicit a personal psychological response from a player. U.S. Pat. No. 4,273,337, which issued to M. Carrera et al. on June 16, 1981, discloses a sex education board game which utilizes a race track type game format and a plurality of question cards. U.S. Pat. No. 4,671,516, which issued to C. Lizzola et al on June 9, 1987, discloses a board game which utilizes a plurality of cards each bearing indicia representing at least one word and a plurality of rewards. The cards are randomly selected and used to construct complete sentences. U.S. Pat. 4,718,675, which issued to A. Rosenberg et al on Jan. 12, 1988, discloses a game of chance in which the object of each player is to gain the least amount of weight. Each player is given a menu containing six pages of daily activities, each activity having twenty-four numbered choices.

While the above mentioned devices are directed to board games, none of these devices disclose a race track type board game which utilizes a multi-colored die to select individuals to be identified from a plurality of different color coded game cards. Inasmuch as the art is relatively crowded with respect to these various types of board games, it can be appreciated that there is a continuing need for and interest in improvements to such board games, and in this respect, the present invention addresses this need and interest.

SUMMARY OF THE INVENTION

In view of the foregoing disadvantages inherent in the known types of board games now present in the prior art, the present invention provides an improved board game. As such, the general purpose of the present invention, which will be described subsequently in greater detail, is to provide a new and improved board game which has all the advantages of the prior art board games and none of the disadvantages.

To attain this, a representative embodiment of the concepts of the present invention is illustrated in the drawings and makes use of a board game which includes a game board having a movement path defined by a plurality of sequential spaces and including start and finish spaces. A plurality of game markers are assigned to game players for movement along the path. A sequentially numbered die is utilized to determine seating order and the order of play among a group of players. A multi-colored die has a plurality of differently colored faces. A plurality of cards each have a front face bearing indicia designating famous individuals in various categories. Each of the cards has a rear face bearing indicia designating a description clue corresponding to each of the famous individuals. The categories are color coded corresponding to the colors of the multi-colored die. A timer is utilized to control the length of each player's turn. During play, each player rolls the multi-colored die to select a category, draws a card and gives verbal descriptive clues to an adjacent player in an attempt to elicit a correct identification of the famous individual in the designated category. The players move their respective game markers in correspondence to the number of correctly elicited responses.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent cOnstructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved board game which provides in the apparatuses and methods of the prior art some of the advantages thereof, while simultaneously overcoming some of the disadvantages normally associated therewith.

Still another object of the present invention is to provide a new and improved entertaining and educational board game involving the identification of a variety of famous individuals in various different categories.

Yet another object of the present invention is to provide a new and improved board game which utilizes a multi-colored die to select a famous individual to be described by verbal clues from a plurality of different color coded categories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
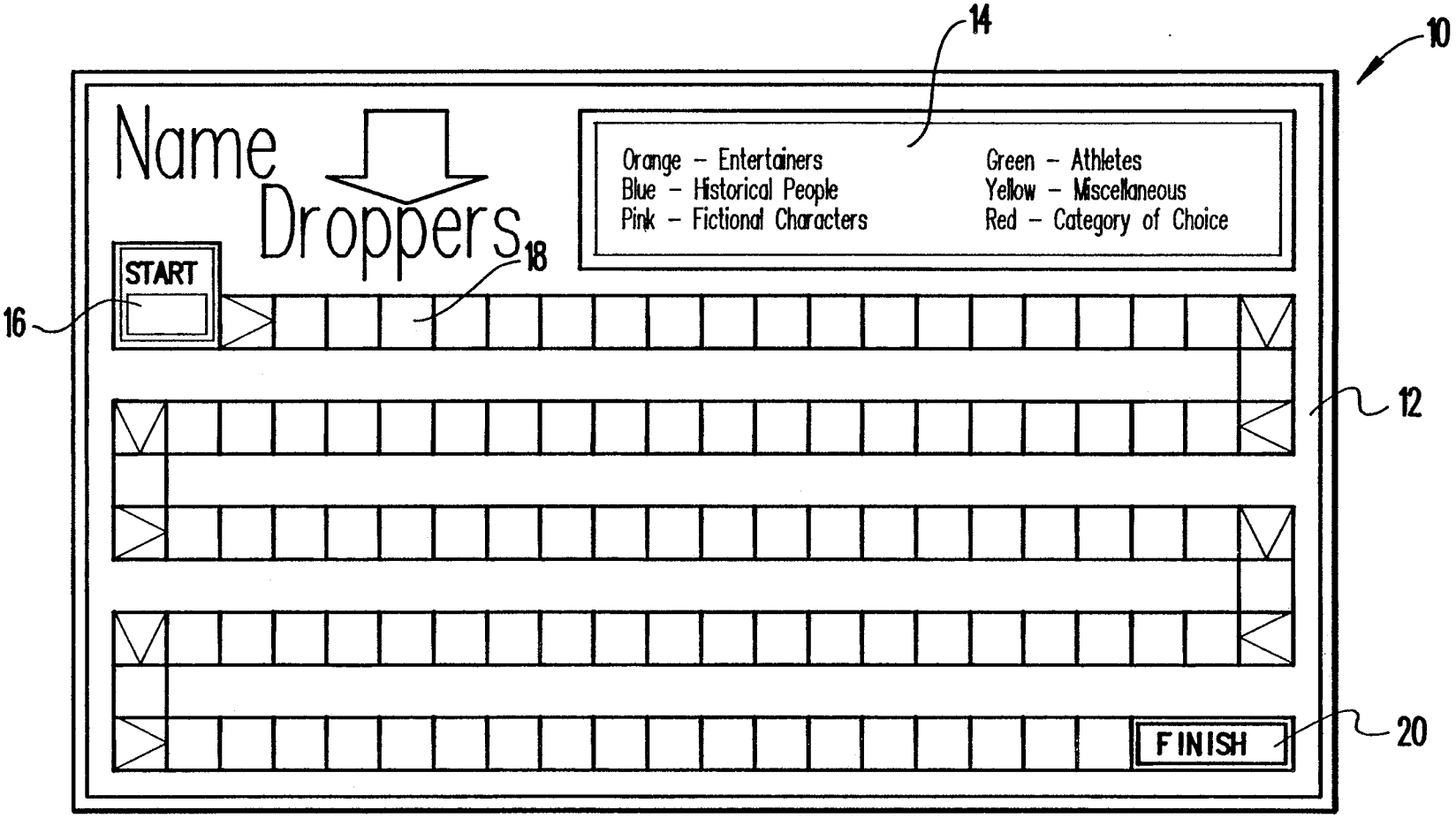
FIG. 1 is a plan view illustrating the game board of the game of the present invention.

With reference now to the drawings, and in particular to FIG. 1 thereof, a new and improved board game embodying the principles and concepts of the present invention and generally designated by the reference numeral 10 will be described.

More specifically, it will be noted that the first embodiment 10 of the invention includes a generally rectangular game board 12 having a movement path 18 formed by a series of sequential spaces. A start 16 and a finish space 20 are designated at opposite ends of the movement path. A category identification block 14 may be provided on the game board as a reminder of the color coding of famous individual categories to game players.

Figure 2:
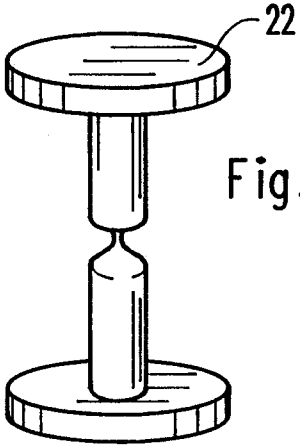
FIG. 2 is a perspective view illustrating an hour-glass type timing device for use in regulating play of the game of the present invention.

As shown in FIG. 2, a timing device is utilized to regulate the length of each player's turn. The timing device may take the form of an hour-glass 22. Preferably, the hour-glass 22 is dimensioned to provide a predetermined time interval of about 30 seconds.

A sequentially numbered die 24 is utilized to determine the order of player seating around a table and the initial order of play.

Figure 4:
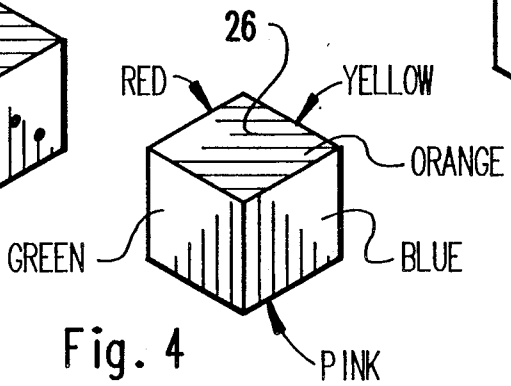
FIG. 4 is a perspective view illustrating a multicolored die.

As shown in FIG. 4, a multi-colored die is utilized to select a color coded famous individual category.

Figure 5:
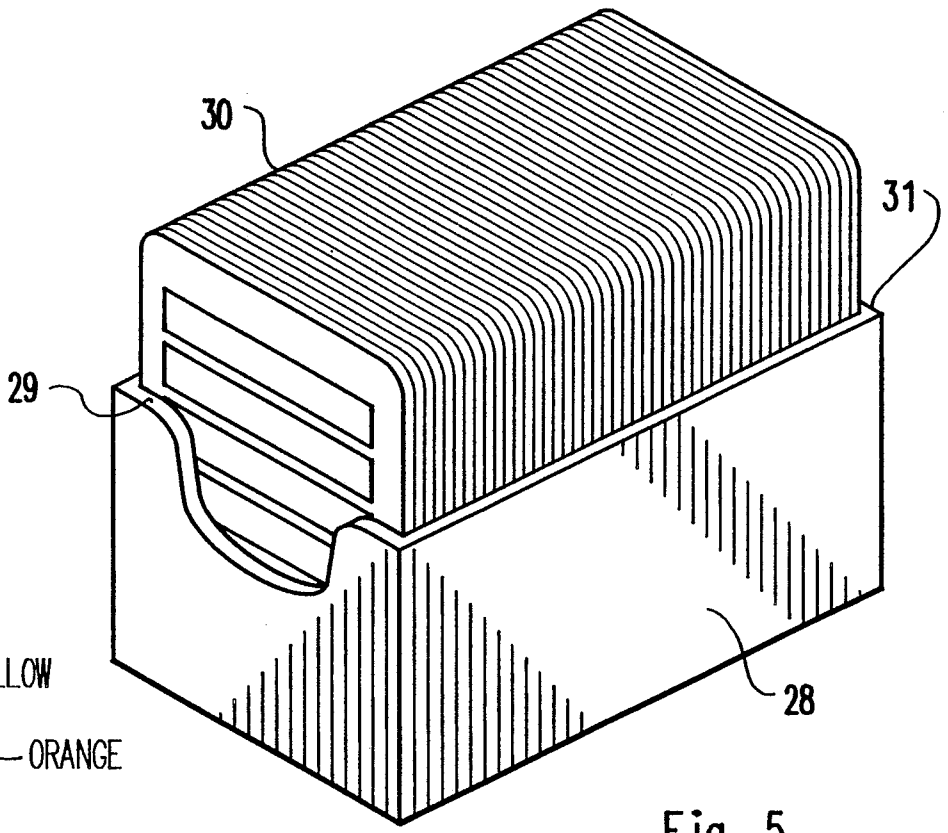
FIG. 5 is a perspective view illustrating a set of individual category cards.

FIG. 5 illustrates a box-like holder 28 which contains a set of famous individual category cards 30. Preferably, about 500 cards are provided in a set, each bearing the name of a famous individual in each of a plurality of different color coded categories. During play, cards are drawn from a first end 29 of the holder 28 and replaced upon a correct identification of a famous individual at a back end of the holder 31 of the holder 28.

Figure 6:
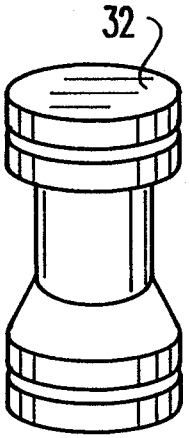
FIG. 6 is a perspective view illustrating an example game marker for movement about the game board of FIG. 1.

As shown in FIG. 6, a plurality of various different colored game markers 32 are provided for movement by respective game players about the game board movement path. The game markers 32 may be formed in different colors and or configurations to identify the associated player.

Figure 7:
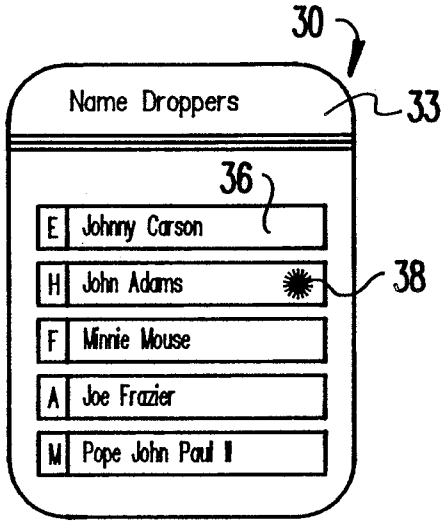
FIG. 7 is a plan view illustrating the front face of a sample game card.

As shown in FIG. 7, each of the game cards 30 include five different categories: ENTERTAINERS, HISTORICAL PEOPLE, FICTIONAL CHARACTERS, ATHLETES and MISCELLANEOUS. Selected ones of the cards 30 may have one of the categories, for example the HISTORICAL PEOPLE category, designated as a bonus category by an asterisk 38 or other suitable indicia. The entertainer category 36 bears the name of a famous individual "JOHNNY CARSON".

Figure 8:
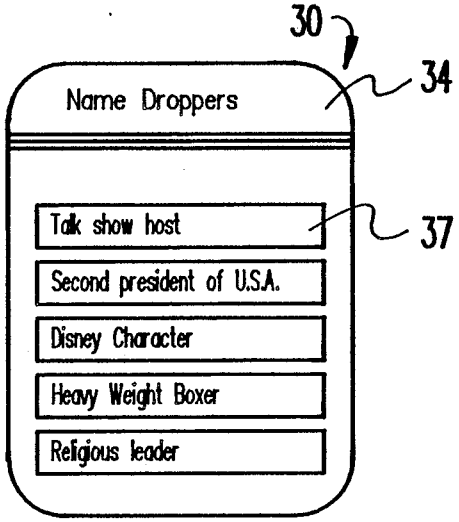
FIG. 8 is a plan view illustrating the back face of the card of FIG. 7.

As shown in FIG. 8, the back face 34 of the card 30 illustrated in FIG. 7 has a plurality of descriptive clues associated with the famous individuals designated on the front face of the card. For example, the clue 37 "TALK SHOW HOST" is a verbal clue which describes the individual "JOHNNY CARSON" in the category 36 on the front face of the card shown in FIG. 7.

Figure 3:
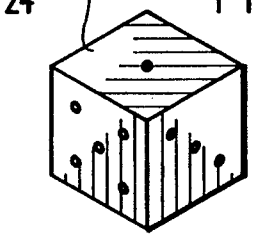
FIG. 3 is a perspective view illustrating a numbered die.
Figure 9:
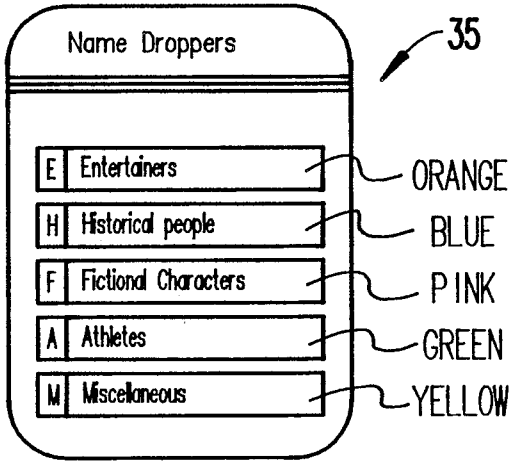
FIG. 9 is a plan view illustrating a category list card.

FIG. 9 is a category identification card 35 which bears the name of each of the subject categories, along with an associated color coding. It should be noted that the category bars on the front and back face of each of the cards 30, as shown in FIGS. 7 and 8, is also color coded. In the play of the game of the present invention, each player of the group initially rolls the numbered die shown in FIG. 3 to determine where they will be seated around a table. The highest roller may be seated anywhere in the circle. The second highest roller sits to the left of the highest roller, etc. The highest roller also begins the play. Initially, each player places their associated game marker on the start space 16 of the game board movement path shown in FIG. 1. The starting player begins by rolling the multi-colored die shown in FIG. 4. The indicated color means the player will be using the associated color coded famous individual category throughout their turn. If the indicated color is red, the initial player may select any of the categories. The timer 22 shown in FIG. 2 is then initiated, and the player selects the first game card 30 from the front end 29 of the box 28 illustrated in FIG. 5. The initial player then provides verbal descriptive clues to the adjacent player on their left side. The player may utilize the sample clue provided on the back face of the card 30 to assist in describing the famous individual. The initial player may also use their own clues until the adjacent player has said the entire name of the famous individual in the designated category on the card. If the initial player does not know anything about the famous name except the given clue, they must break the name apart and describe parts of it as best they are able. The initial player cannot mention the letters in the name, nor give a word that rhymes therewith. If the initial player succeeds in having the adjacent player reveal the name of the famous individual, the player continues by selecting another card from the front end 29 of the box 28 until the 30 seconds time interval has expired. If the initial player was in the middle of a description that the adjacent player had not correctly revealed by the end of the time interval, the initial player must not reveal the name and must place the card back at the front end 29 of the card box 28. The initial player and the adjacent player then advance their game markers one space on the game board movement path for each name successfully described and guessed. This manner of scoring provides the necessary incentive for both the clue giver and clue receiver. The initial player also advances one additional space for successfully given clues in a bonus category as indicated by the asterisk 38 on the sample card 30 shown in FIG. 7. During the course of play, any number of game markers may occupy the same space on the movement path. The game cards upon which the famous individual in the designated category has been correctly revealed are inserted in the back end 31 of the card box 28. Upon expiration of the initial player's time interval, the multicolored die is then passed to the adjacent player who continues play in the above described manner, by giving descriptive verbal clues to the player on their immediate left. Play continues in sequential fashion until one of the players have moved their associated game marker to the finish space 20 on the game board movement path. In the case of a tie, the player giving the clues wins It is contemplated that three or more players may play the game of the present invention, with six markers provided. If more than six players wish to play, additional markers can be utilized.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a game, comprising the steps of:

providing:

a game board, a movement path formed by a plurality of discreet spaces and including start and finish spaces defined on said game board;

a plurality of game markers for movement along said path;

a sequentially numbered die;

a multi-colored die having differently colored faces;

a plurality of cards, each of said cards having a front face bearing indicia designating a famous individual in each of a plurality of different categories, said categories color coded in correspondence with said multi-colored die, and each of said cards having a rear face bearing indicia designating a description clue corresponding to each of said individuals;

timing means for controlling length of each turn of play;

determining a seating and play order among a group of players by rolling said numbered die;

assigning a different one of said game markers to each player;

an initial player rolling said multi-colored die to determine a category, said initial player selecting a category of choice upon rolling a predetermined one of said colors;

starting said timing means;

said initial player drawing one of said cards and giving verbal clues to an adjacent player describing the famous individual in the selected category;

said initial player continue to draw cards and describe individuals in the indicated category upon correct identification of an individual by the adjacent player:

said initial player stopping play upon expiration of a predetermined time interval indicated by said timing means;

said initial player replacing any unidentified cards without revealing the individual upon expiration of said time interval;

said initial player and said adjacent player moving their game markers along said game board movement path corresponding to the number of correctly identified individuals;

and continuing play in the above manner in sequential fashion among said group of players until one of said game markers reaches said finish space.

2. The board game of claim 1, further comprising the step of designating bonus categories on a predetermined number of said cards and moving said game markers an additional space along said game board movement path upon direct identification of an individual in one of said bonus categories.

* * * * *